US005362267A

United States Patent [19]

Forrest

[11] Patent Number: 5,362,267

[45] Date of Patent: Nov. 8, 1994

[54] SOLAR POWERED BUOY

[76] Inventor: Cynthia K. Forrest, 337 S. Weller Ave., Springfield, Mo. 65802

[21] Appl. No.: 93,337

[22] Filed: Jul. 19, 1993

[51] Int. Cl.[5] ..... B63B 21/52

[52] U.S. Cl. ..... 441/16; 362/341; 362/362; 441/20

[58] Field of Search ..... 441/1, 6, 7, 10, 11, 441/12, 13, 14, 16, 20, 32; 136/244, 291; 362/183, 217, 317, 341, 347, 350, 362, 367

[56] References Cited

U.S. PATENT DOCUMENTS

| | | | |
|---|---|---|---|
| 3,618,150 | 11/1971 | Anselmi | 441/20 |
| 4,344,110 | 8/1982 | Ruediger | 441/16 |
| 4,481,562 | 11/1984 | Hickson . | |
| 4,484,104 | 11/1984 | O'Brien . | |
| 4,501,564 | 2/1985 | Cairone, Sr. | 441/20 |
| 4,626,852 | 12/1986 | Dodge . | |
| 4,750,735 | 7/1988 | Pagnol et al. . | |
| 4,809,458 | 3/1989 | Tanikuro et al. . | |
| 4,898,124 | 1/1991 | Shappell . | |
| 4,999,060 | 3/1991 | Szekely et al. . | |
| 5,066,256 | 11/1991 | Ward, Sr. . | |
| 5,121,307 | 6/1992 | Moore . | |
| 5,251,113 | 10/1993 | Wagoner et al. | 441/13 |

FOREIGN PATENT DOCUMENTS 2115915A 9/1983 United Kingdom .

*Primary Examiner*—Stephen P. Avila

*Attorney, Agent, or Firm*—Litman, McMahon & Brown

[57] ABSTRACT

A solar powered lantern device is visible even without a beacon under reflected light and can be easily color coded to conform to the marking requirements of a new location. The lantern device includes a housing, a lighting element supported by a luminescent internal frame, a photovoltaic power supply, and an omnidirectional reflector. In particularly preferred forms, the lantern device is a buoy having a modular housing with interchangeable colored elements. A lighting element is centrally supported inside the housing by a luminescent frame, which serves to reflect light from approaching craft when the lighting element fails. The device may also be mounted atop a pole. In preferred forms the frame is hollow and forms a conduit for electrical conductors from the power supply to the lighting element. A pair of conical reflectors is positioned within the housing to reflect the beacon light omnidirectionally.

20 Claims, 1 Drawing Sheet

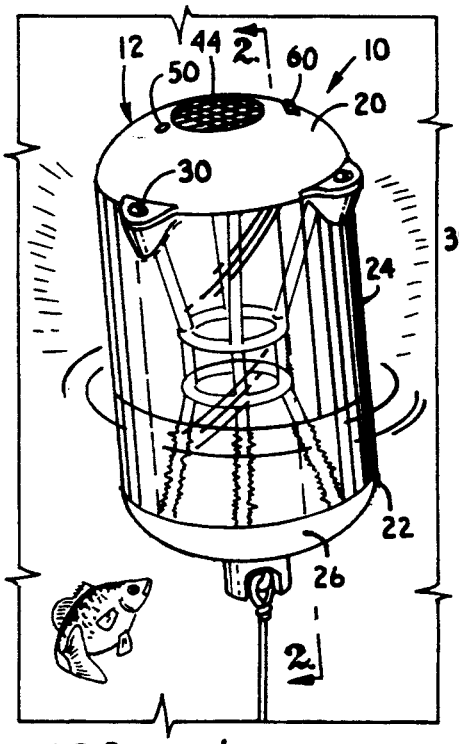
Fig.1.
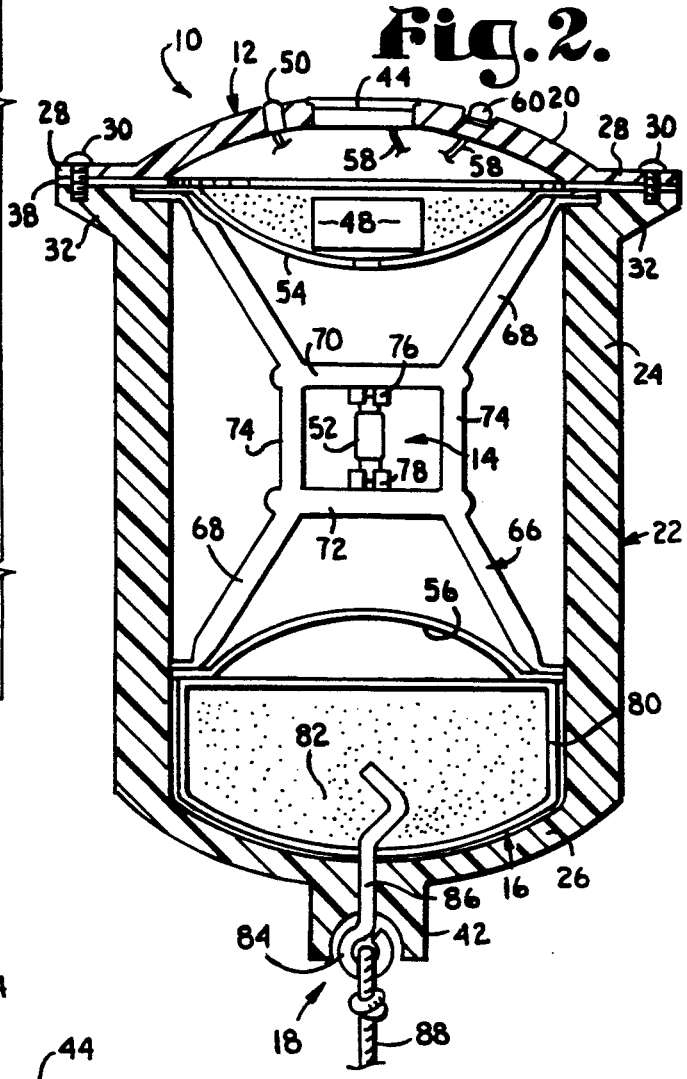
Fig.2.
Fig.3.
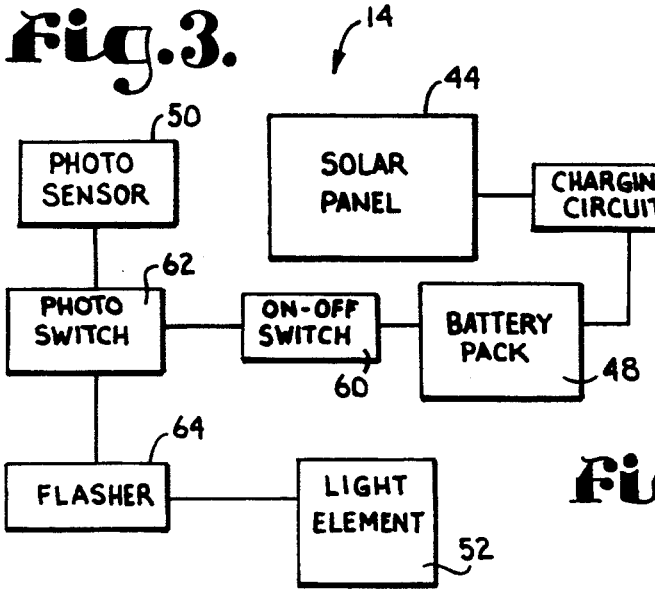
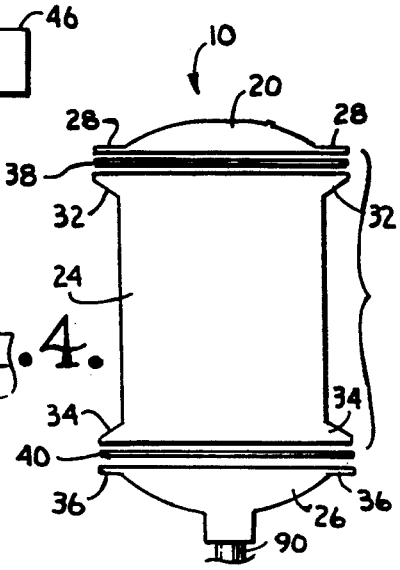
Fig.4.

SOLAR POWERED BUOY

BACKGROUND OF THE INVENTION

1. Field of the Invention

The present invention is broadly concerned with a solar powered lantern device such as a buoy or the like which is luminescent at night, is constructed of interchangeable components for varying the signal markings and color of the signal light, and which emits a beacon visible from all directions. More particularly, it is concerned with a lantern having modular housing components, a reflective internal support frame, a pair of cone-shaped reflectors, and a mounting assembly which permits the device to be moored in the water or mounted atop a pole.

2. Description of the Related Art

Solar powered lantern devices are preferable in many instances to conventional electrical and hydrocarbon fueled lanterns because they do not require connection to an external electrical power source or frequent refueling. They are especially well-suited for use as maritime buoy markers or signals. Since malfunction of the photovoltaic power system can cause failure of the beacon, such markers are commonly coated with a fluorescent material so that they will maintain a measure of nighttime visibility. In this manner, the buoy reflects light from approaching craft. Such coatings are impermanent however, and are subject to degradation such as flaking and peeling upon prolonged exposure to the elements.

The maritime buoyage system in common use employs a system of color coding of the top, middle, and bottom of the buoy as well as the beacon to identify direction, danger and safe water areas. Unless a buoy is to be permanently dedicated to a single marking use, it must be remarked to the appropriate color code prior to removal to a differently coded location. While permanent color coding may be accomplished by selective painting or coating of the buoy, such coatings are impermanent, and may not easily be changed.

Where a single lighting element is employed, it is generally mounted atop the buoy, rather than in the center. Such top-mounted beacons are subject to damage by debris, boats, and waterskiers, as well as fouling by birds. Where a reflector is employed to enhance the visibility of the light, it serves to shade the beacon light in the non-reflective direction.

U.S. Pat. Nos. 4,809,458 issued to Tanikuro et al. and 4,626,852 issued to Dodge do not permit interchangeable buoy marking components, do not reflect light to the area below the lower hemisphere of the buoy, and do not provide a weather-shielded reflector element in case the lighting element fails.

SUMMARY OF THE INVENTION

The present invention overcomes the problems previously outlines and provides a greatly improved solar powered lantern device which is visible even without a beacon under reflected light and which can be easily color coded to conform to the marking requirements of a new location. Broadly speaking, the lantern device includes a housing, a lighting element supported by a luminescent internal frame, a photovoltaic power supply, and an omnidirectional reflector.

In particularly preferred forms, the lantern device is a buoy having a modular housing with interchangeable colored elements. A lighting element is centrally supported inside the housing by a luminescent frame, which also serves to reflect light from approaching craft when the lighting element fails. The lantern device may be also be mounted atop a pole. In preferred forms the frame is hollow and forms a conduit for electrical conductors from the power supply to the lighting element. A pair of conical reflectors is positioned within the housing to reflect the beacon light omnidirectionally.

OBJECTS AND ADVANTAGES OF THE INVENTION

The principal objects and advantages of the present invention include: providing a solar powered lantern device which may be employed as a buoy or mounted atop a pole; providing such a device including a luminescent material for reflecting light under conditions of beacon failure; providing such a device which includes a luminescent internal support frame; providing such a device having a hollow support frame which forms a conduit for electrical conductors from the power supply to the lighting element; providing such a device having a lighting element which is centrally supported inside the housing; providing such a device having a modular housing constructed of interchangeable elements; providing such a device having an omnidirectional reflector for 360° reflection of the beacon light; providing such a device including a photovoltaic power supply including a solar panel, a storage battery, and electrical conductors; providing such a device which includes a flashing beacon; providing such a device which includes a transparent lens portion; providing such a device which includes a photosensor and photoswitch for automatic switching on of the beacon in darkness and off in daylight; providing such a device which is floatable in the water in an upright position; providing such a device which may be moored to a selected location.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of the solar powered lantern of the invention employed as a buoy;

FIG. 2 is a sectional view taken along line 2—2 of FIG. 1;

FIG. 3 is a schematic diagram of the lighting assembly electrical circuit; and FIG. 4 is an outline of an alternate embodiment of the lantern of the invention having modular housing components and adapted for mounting atop a pole.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

II. Solar Powered Lantern Device

It is to be understood that while certain forms of the present invention have been illustrated and described herein, it is not to be limited to the specific forms or arrangement of parts described and shown.

Referring now to the drawing, a solar powered lantern device 10 in accordance with the invention broadly includes a housing 12, lighting assembly 14, flotation assembly 16, and mounting assembly 18.

In more detail, generally cylindrical housing 12 includes a top cover 20, and a bottom portion 22. Bottom portion 22 includes a transparent upper lens portion 24, and a lowermost bottom cover 26. Bottom cover 26 may be integrally constructed to include a transparent lens portion 24 as depicted in FIG. 2, or the lens may be of separate construction, as depicted in FIG. 4. Housing 12 and top and bottom covers 20, 26 are preferably formed of synthetic resinous material or fiberglass, although they may also be constructed of metal, or any other suitable material. They may also be constructed to cooperatively form any geometric configuration, such as a sphere, or fanciful figure, such as a frog or fish. Lens 24 may be formed of any suitable transparent material such as a synthetic resinous material, or even of glass, and may be tinted so that a colored signal beacon is emitted. Housing 12, top and bottom covers 20, 26, and lens 24 may also be colored in conventional maritime signal colors, or in fluorescent or fanciful colors.

Top 20 includes outstanding apertured flanges 28 located at spaced intervals for accommodating retaining screws 30. The uppermost portion of lens 24 similarly includes outstanding apertured flanges 32 located at corresponding spaced intervals and including sleeves for mating engagement with screws 30. As depicted in FIG. 4, where lens 24 is of separate construction, the lowermost portion of lens 24 and bottom 22 each include outstanding apertured flanges 34, 36 at corresponding spaced intervals. Seals 38, 40 fit between flanges 28, 32 and 34, 36 respectively for maintaining housing 12 in watertight condition. Where bottom cover 26 is of unitary construction with lens 24, flanges 34, 36 and lower seal 40 are omitted. The center portion of bottom cover 26 includes a socket 42, which may be threaded.

As best shown in FIGS. 2 and 3, lighting assembly 14 includes a photovoltaic solar panel 44, a charging circuit 46, battery pack 48, photo sensor 50, lighting element 52, and pair of reflectors 54, 56.

Solar panel 44 is generally comprised of a series of individual converters. In preferred forms a photovoltaic cell such as Solarex MSX01 is employed. Charging circuit 46 regulates the voltage and current produced by solar panel 44 to ensure that it is compatible with battery 48. Circuit 46 includes a circuit board (not shown), electrical conductors 58 (only two are shown), and a switch 60 having on, off, and automatic positions. Battery pack 48 preferably consists of two size C nickel-cadmium rechargeable batteries, although conventional batteries may be employed and the solar panel omitted in smaller buoys used, for example, on trot lines. Photo sensor eye 50 is coupled with a photo switch 62, which switches the circuit on or off depending on the ambient light level, and a flasher element 64. Those skilled in the art will appreciate that photo sensor 50 and photo switch 62 may be combined in a single unit such as a phototransistor. Lighting element 52 includes a support assembly 66 having a series of legs 68, coupled with a pair of generally circular members 70, 72, which in turn are coupled in spaced relationship by vertical support members 74 to cooperatively form a cage for supporting and protecting lighting element 52. Upper and lower sockets 76, 78 couple lighting element 52 with upper and lower circular members 70, 72, respectively.

In preferred forms, support assembly 66 is formed of hollow, luminescent (such as fluorescent) synthetic resinous tubing material so as to serve as a protective conduit for electrical conductors 58. In other preferred forms, electrical conductors 58 may be integrally molded into solid tubing material. Those skilled in the art will appreciate that support assembly 66 can be constructed in any of a number of alternate configurations and should not be limited to the configuration described.

Lighting element 52 may be a conventional filament-type bulb or a fluorescent-type bulb, coupled with a single socket, or with a pair of sockets in generally vertical orientation as depicted in FIG. 2, or any other suitable light-emitting element coupled in generally horizontal or other orientation. Reflectors 54, 56 are generally conical or parabolic in shape and are mounted by support assembly legs 68 in spaced relationship to lighting element 52 so that emitted light is reflected omnidirectionally, for 360° visibility of the buoy. In preferred forms each reflector is constructed so as to present a multifaceted prismatic surface. In especially preferred forms, the reflectors are constructed of a light weight, flexible reflective material such as, for example, Alcoa Everbrite$_{TM}$, or any other suitable reflective material.

Flotation assembly 16 includes a ballast container 80, which is filled with ballast 82 such as sand, rocks or any other ballast material. An identifier plate or other signage may be inserted between container 80 and housing 12 so that it is visible through lens 24.

Mounting assembly 18 includes a hook 84, such as an eye hook having a shank 86 which extends upwardly through apertured bottom socket 42 and is anchored into ballast 82. Hook shank 86 may also be transversely coupled with the center of a flattened disc. Lantern 10 can be floated on the water as a buoy and anchored to a sinker (not shown) by a line 88 or a chain. Lantern 10 may also be mounted atop a pole 90, which may in turn be attached to a floating buoy or to a dock, boat, or any other suitable object.

III. Operation

Lantern device is mounted atop a buoy or pole 90 by coupling threaded socket 42 with a correspondingly threaded fitting. Alternatively, it may be floated in the water and anchored to a sinker by a line 88 coupled with eyehook 84. A user sets switch 60 to the "on" position to operate the light continuously, or to the "automatic" position to permit activation of the beacon by a photosensor when ambient light decreases below a predetermined level.

During periods of full or partial sunshine, light rays strike photoreceptors in the solar panel 44, where they are converted to electrical energy and transmitted through charging circuit 46 to rechargeable battery cells 48 for storage. Upon manual activation of switch 60, or activation of photo switch 62 by photo sensor 50, electrical energy is delivered from battery 48 to light element 52 to produce a beacon. If a flasher is included in the circuitry, a flashing beacon is emitted. The emitted light is mirrored in all directions by conical reflector elements 54, 56, so that the lantern is visible from all angles, including underwater.

During periods of low light, boats and other sources of light are reflected from luminescent light element support assembly 66, so that the buoy is visible in the lights of oncoming boat traffic even if the light element fails.

The top and bottom markings of the buoy and the color of the beacon emitted can be altered by uncoupling modular top, bottom and lens housing elements and interchanging them with similar modular elements of different colors.

Lantern device 10 may also be assembled by a user from a kit comprised of component parts by placing seal 40 between bottom cover 26 and lens 24, aligning bottom cover and lens flanges 36, 34 respectively, and inserting retaining screws, loading ballast container 80 with any commonly available ballast, and installing it over bottom cover 26. A reflector 56 is next installed over ballast container 80, followed by light element support assembly 66, fitted with lighting element 52. Top reflector 54 is inserted atop support assembly legs 68, followed by battery 48 and seal 40. Preassembled top cover 20 includes electrical conductors 58, which are coupled with battery 48, prior to insertion of seal 38. Top cover and lens flanges 28, 32 are aligned and screws 30 are inserted.

Having described the preferred embodiments of the present invention, the following is claimed as new and desired to be secured by letters Patent.

I claim:

1. A self-contained floating buoy with a solar powered lantern, comprising:

(a) a housing, having a bottom portion including a flotation assembly in a lowermost section and an uppermost transparent lens section, and a top portion;

(b) a lighting element for emitting a signal light;

(c) a frame supporting said lighting element inside said housing in spaced relationship to said top portion and said lowermost section of said bottom portion;

(d) a photovoltaic power supply including a solar panel, and a storage battery;

(e) electrical conductor means coupling said power supply with said lighting element; and (f) reflecting means coupled with said housing for omnidirectional reflecting of said signal light, said reflecting means including a pair of spaced, generally parabolic reflector members, one positioned above and one positioned below said signal light, one of said parabolic reflectors being coupled with said top portion of said housing and the other of said reflector members being attached to said lowermost section of said bottom housing portion.

2. The buoy of claim 1, wherein said housing portions comprise modular elements which may be interchanged with similar modular elements of different colors for varying the appearance of said buoy and the color of said emitted signal light.

3. The solar-powered lantern device of claim 1, wherein said lighting element further includes a flashing element, for permitting flashing of said emitted signal light.

4. The apparatus as set forth in claim 1, wherein said frame is luminescent and comprises a hollow conduit for said electrical conductor means.

5. The apparatus as set forth in claim 1, wherein said frame is luminescent and further includes a pair of matching top and bottom portions, each presenting a plurality of spaced legs, coupled with a central cage portion including a pair of generally circular elements intercoupled by a plurality of spaced, generally vertical support members.

6. The apparatus as set forth in claim 1, wherein said reflector members each present a multifaceted prismatic surface.

7. A solar-powered lantern device, comprising:

(a) a housing having a plurality of modular elements including a bottom portion, a transparent lens portion, and a top portion, (b) a lighting element for emitting a signal light;

(c) wherein said modular housing elements may be interchanged with similar modular elements of different colors, for varying the appearance of said lantern device and the color of said emitted signal light;

(d) a frame supporting said light element inside said housing in spaced relationship to said top and bottom portions;

(e) a photovoltaic power supply including a solar panel, and a storage battery;

(f) electrical conductor means coupling said power supply with said lighting element; and (g) reflecting means coupled with said housing for omnidirectional reflecting of said signal light, said reflecting means including a pair of spaced, generally parabolic reflector members, one positioned above and one positioned below said signal light.

8. The apparatus as set forth in claim 7, wherein said solar powered lantern device is a buoy.

9. The solar-powered lantern device of claim 7, wherein said lighting element further includes a flashing element, for permitting flashing of said emitted signal light.

10. The apparatus as set forth in claim 7, wherein said frame is luminescent and comprises a hollow conduit for said electrical conductor means.

11. The apparatus as set forth in claim 7, wherein said frame is luminescent and further includes a pair of matching top and bottom portions, each presenting a plurality of spaced legs, coupled with a central cage portion including a pair of generally circular elements intercoupled by a plurality of spaced, generally vertical support members.

12. The apparatus as set forth in claim 7, wherein said reflector members each present a multifaceted prismatic surface.

13. A solar powered lantern buoy device, comprising:

(a) a housing, having a bottom portion including an uppermost transparent lens portion, and a top portion;
(b) a lighting element for emitting a signal light;
(c) a photovoltaic power supply including a solar panel and a photosensor mounted atop said housing top portion, a photoswitch and a storage battery;
(d) electrical conductor means coupling said power supply and said lighting element;
(e) a frame supporting said light element inside said housing in spaced relationship to said top and bottom portions;
(f) a pair of spaced, generally parabolic reflector members, each of said members being coupled with a respective one of said top and bottom housing portions for omnidirectional reflecting of said signal light, with one of said reflector members positioned above and the other of said reflector members placed below said signal light;
(g) flotation means including a watertight seal and a ballast member coupled with said bottom portion of said housing for permitting flotation of said buoy in the water in generally upright orientation; and
(h) a mooring member coupled with said housing bottom portion for mooring said buoy to a stationary member.

14. The apparatus as set forth in claim 13, wherein said frame is luminescent and comprises a hollow conduit for said electrical conductors.

15. The apparatus as set forth in claim 13, wherein said frame is luminescent and further includes a pair of matching top and bottom portions, each presenting a plurality of spaced legs, coupled with a central cage portion including a pair of generally circular elements intercoupled by a plurality of spaced, generally vertical support members.

16. The solar-powered lantern device of claim 13, wherein said housing portions comprise modular elements which may be interchanged with similar modular elements of different colors for varying the appearance of said lantern device and the color of said emitted signal light.

17. The apparatus as set forth in claim 13, wherein said reflector members each present a multifaceted prismatic surface.

18. A solar powered lantern device, comprising:
(a) a lantern housing, having a bottom portion including an uppermost transparent lens portion, and a top portion;
(b) a lighting element for emitting a signal light;
(c) a luminescent frame supporting said lighting element inside said lantern housing in spaced relationship to said top and bottom portions, said luminescent frame further including a pair of matching top and bottom portions, each presenting a plurality of spaced legs, coupled with a central cage portion including a pair of generally circular elements intercoupled by a plurality of spaced, generally vertical support members;
(d) a photovoltaic power supply including a solar panel, and a storage battery;
(e) electrical conductor means coupling said power supply with said lighting element; and
(f) reflecting means coupled with said lantern housing for omnidirectional reflecting of said signal light.

19. A solar-powered lantern device, comprising:
(a) a housing having a plurality of modular elements including a bottom portion, a transparent lens portion, and a top portion,
(b) a lighting element for emitting a signal light;
(c) wherein said modular housing elements may be interchanged with similar modular elements of different colors, for varying the appearance of said lantern device and the color of said emitted signal light;
(d) a luminescent frame supporting said light element inside said lantern housing in spaced relationship to said top and bottom portions, said luminescent frame including a pair of matching top and bottom portions, each presenting a plurality of spaced legs, coupled with a central cage portion including a pair of generally circular elements intercoupled by a plurality of spaced, generally vertical support members;
(e) a photovoltaic power supply including a solar panel, and a storage battery;
(f) electrical conductor means coupling said power supply with said lighting element; and
(g) reflecting means coupled with said lantern housing for omnidirectional reflecting of said signal light.

20. A solar powered lantern buoy device, comprising:
(a) a lantern housing, having a bottom portion including an uppermost transparent lens portion, and a top portion;
(b) a lighting element for emitting a signal light;
(c) a photovoltaic power supply including a solar panel and a photosensor mounted atop said housing top portion, a photoswitch and a storage battery;
(d) electrical conductor means coupling said power supply and said lighting element;
(e) a luminescent frame supporting said light element inside said lantern housing in spaced relationship to said top and bottom portions, said luminescent frame including a pair of matching top and bottom portions, each presenting a plurality of spaced legs, coupled with a central cage portion including a pair of generally circular elements intercoupled by a plurality of spaced, generally vertical support members;
(f) a pair of spaced, generally parabolic reflector members, each of said members being coupled with a respective one of said top and bottom housing portions for omnidirectional reflecting of said signal light;
(g) flotation means including a watertight seal and a ballast member coupled with said bottom portion of said lantern housing for permitting flotation of said buoy in the water in generally upright orientation; and
(h) a mooring member coupled with said housing bottom portion for mooring said buoy to a stationary member.

* * * * *